US006932542B2

(12) United States Patent
Chianis et al.

(10) Patent No.: US 6,932,542 B2
(45) Date of Patent: Aug. 23, 2005

(54) TENSION LEG PLATFORM HAVING A LATERAL MOORING SYSTEM AND METHODS FOR USING AND INSTALLING SAME

(75) Inventors: John W. Chianis, Katy, TX (US); Edward W. Huang, Houston, TX (US)

(73) Assignee: Deepwater Marine Technology L.L.C., George Town (KY)

( * ) Notice: Subject to any disclaimer, the term of this patent is extended or adjusted under 35 U.S.C. 154(b) by 0 days.

(21) Appl. No.: 10/618,845

(22) Filed: Jul. 14, 2003

(65) Prior Publication Data

US 2005/0013666 A1 Jan. 20, 2005

(51) Int. Cl.[7] ..... B63B 21/50

(52) U.S. Cl. ..... 405/223.1; 405/195.1; 405/205; 405/224; 114/230; 114/293

(58) Field of Search ..... 405/195.1, 203–206, 405/209, 223.1, 224; 114/264, 293, 294, 230, 231

(56) References Cited

U.S. PATENT DOCUMENTS

| | | | | | |
|---|---|---|---|---|---|
| 2,986,889 | A | * | 6/1961 | Ludwig | 405/224 |
| 3,422,783 | A | * | 1/1969 | Moulin | 114/144 B |
| 3,580,207 | A | * | 5/1971 | Pangalila | 114/144 B |
| 3,837,309 | A | * | 9/1974 | Biewer | 114/265 |
| 3,948,201 | A | * | 4/1976 | Takeda et al. | 114/144 B |
| 3,952,684 | A | * | 4/1976 | Ferguson et al. | 114/230.2 |
| 4,170,266 | A | * | 10/1979 | Fayren | 175/7 |
| 4,352,599 | A | * | 10/1982 | Goldsmith | 405/224 |
| 4,913,238 | A | * | 4/1990 | Danazcko et al. | 405/223.1 |
| 4,936,710 | A | * | 6/1990 | Petty et al. | 405/224 |
| 5,054,415 | A | * | 10/1991 | Marshall | 114/293 |
| 5,088,859 | A | * | 2/1992 | Devlin | 405/211 |
| 5,159,891 | A | * | 11/1992 | Lohr et al. | 114/230.2 |
| 5,330,293 | A | * | 7/1994 | White et al. | 405/211 |
| 5,855,178 | A | * | 1/1999 | Treu et al. | 114/230.2 |
| 6,027,286 | A | * | 2/2000 | Pollack | 405/195.1 |

FOREIGN PATENT DOCUMENTS

| | | | |
|---|---|---|---|
| EP | 287243 | * | 10/1988 |
| EP | 357269 | * | 3/1990 |
| GB | 2258852 | * | 2/1993 |

* cited by examiner

*Primary Examiner*—Jong-Suk (James)) Lee
(74) *Attorney, Agent, or Firm*—Bracewell & Giuliani LLP

(57) ABSTRACT

A lateral mooring system for tendon-based platforms is disclosed, which provides reduced installation and/or operational cost associated with the installation and operation of an extended-base tension leg platform. The lateral mooring system includes a plurality of mooring lines that provide lateral support to the platform in mild metocean conditions, but may have application in more severe oceanic condition. A method for installing the system on the platform and a method for drilling wells on a offshore site.

17 Claims, 6 Drawing Sheets

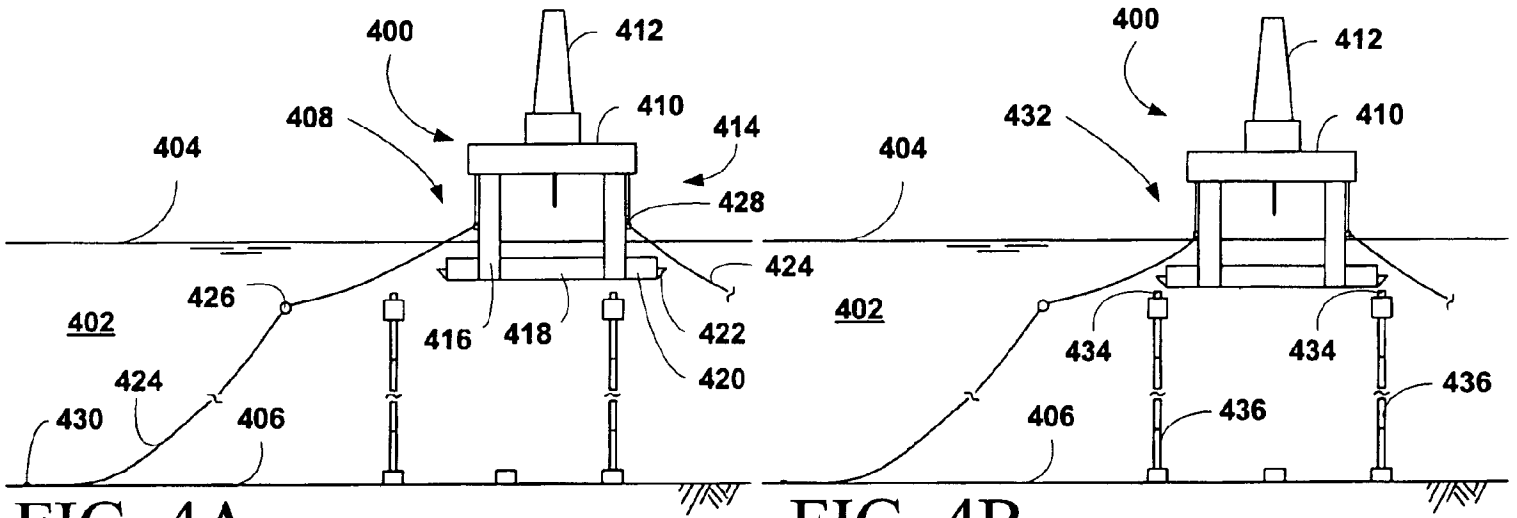
FIG. 4A
FIG. 4B
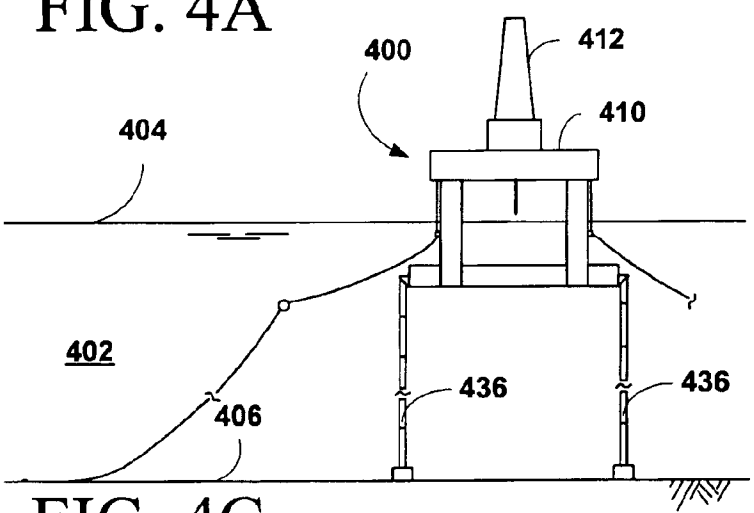
FIG. 4C
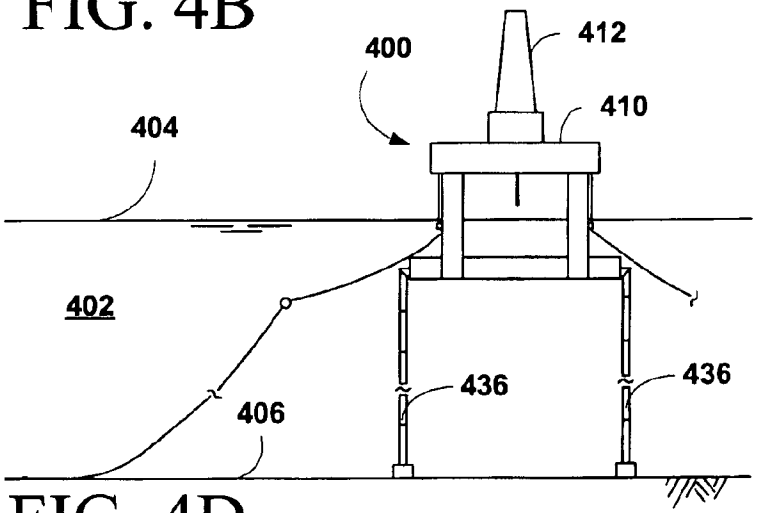
FIG. 4D

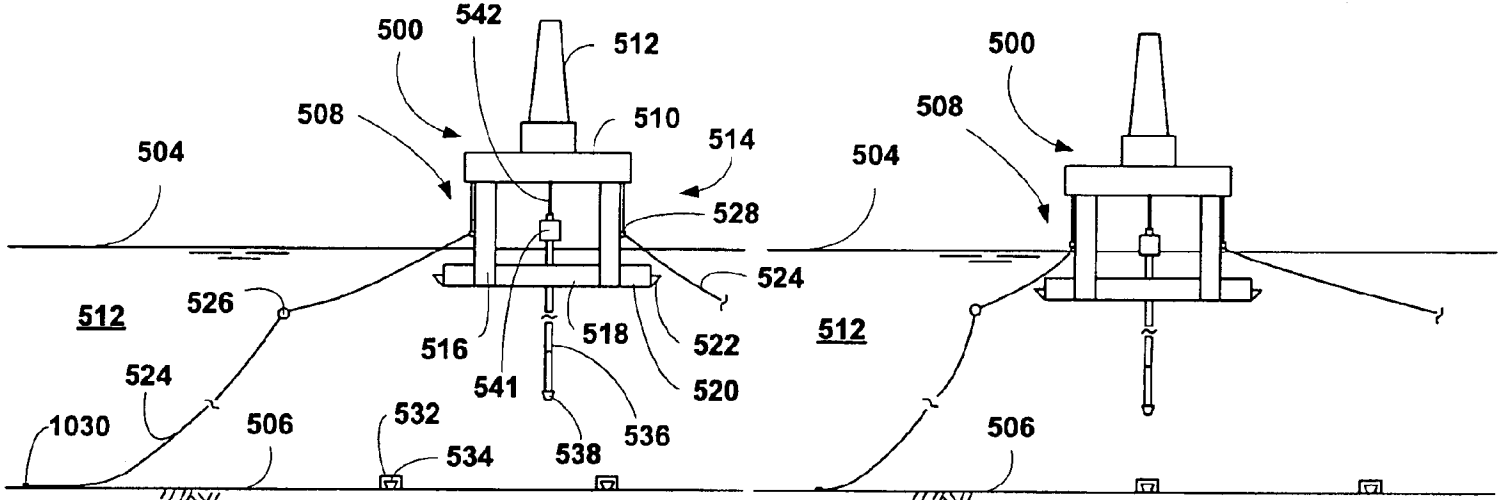
FIG. 5A
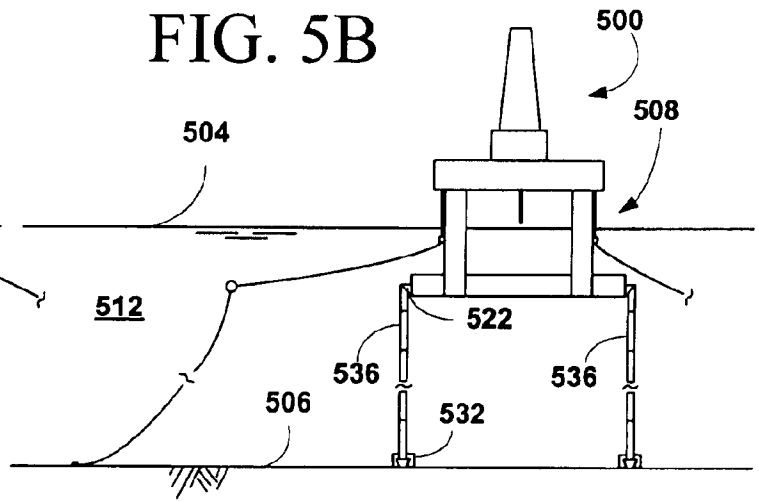
FIG. 5B
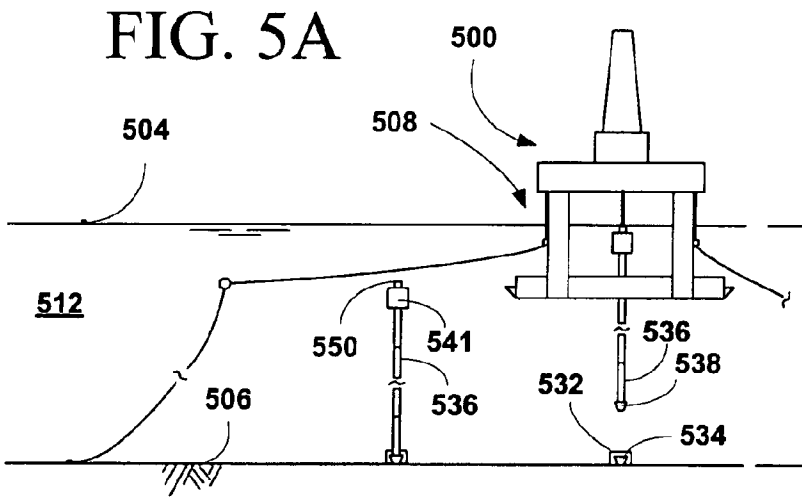
FIG. 5C
FIG. 5D

TENSION LEG PLATFORM HAVING A LATERAL MOORING SYSTEM AND METHODS FOR USING AND INSTALLING SAME

BACKGROUND OF THE INVENTION

1. Field of the Invention

The present invention relates to offshore platforms anchored to a seafloor with tendons and having a lateral mooring system (LMS) for use the oil and gas industry, where the LMS affords improved horizontal stability, improved platform positioning, improved platform installation, and improved platform operations and to methods for installing and using same.

More particularly, the present invention relates to TLPs or other similar offshore platforms having a lateral mooring system (LMS) for use in the oil and gas industry and in particular, to TLPs and extend-base tension leg platforms (ETLPs), where the LMS is adapted to reduce installation and/or operation costs and to provide multiple installation and/or operation performance benefits such as improved horizontal stability, improved platform installation, improved platform operations and to methods for platform positioning, installation, and operation using the LMS.

2. Description of the Related Art

Many offshore platform and platform substructures have been described in the prior art. Many of these substructures are so-called large platform support structures that anchor to the seabed by means of an array of tendons. These tendons form a pattern that define the boundaries of a relatively large area of the seabed. Compact substructures are also known in the art, but they generally employ a central column with radially disposed arms. Such large and compact platforms are disclosed in the following U.S. Pat. Nos: 3,982,492, 4,421,436, 4,793,738, 4,913,233, 4,938,632, 4,983,073, 5,147,148, 5,381,865, 5,421,676, 5,431,511, 5,433,273, 5,549,164, 5,507,598, 5,567,086, 5,669,735, and 5,775,846, incorporated herein by reference. However, these structures do not include features of the present invention. For example, these structures do not include an array of arms or wings that radiate outwardly from a multi-columned, wave transparent substructure that minimizes or at least reduces the fatigue imposed on the anchoring tendons.

More recently, tension leg platforms including lateral extension to extend the platforms base have been developed and are the subject of U.S. Pat. No. 6,447,208, incorporated herein by reference, incorporated herein by reference.

Although TLPs, ETLPs and other offshore platforms used in the oil and gas industry are used in many offshore drilling and production applications, there is still a need in the art for improving installation and/or operation of the such platforms, especially during initial positioning, installation, and post-installation operations.

SUMMARY OF THE INVENTION

Offshore Platforms Having a Lateral Mooring System (LMS)

The present invention provides a tendon-anchored offshore platform including a lateral mooring system (LMS), where the LMS includes a plurality of catenary mooring lines anchored to a seabed and attached to the platform, where the LMS is designed to reduce installation and/or operation costs and/or to provide installation and/or operation performance benefits and where the LMS can be attached to the platform prior to, during or after tendon installation. Preferably, mooring lines are anchored to the seabed in a spaced apart configuration surrounding an installation site of the platform, that may include buoys that adjust the vertical component of the mooring line forces acting on the platform and attached to the platform in a pattern adapted to allow the LMS to impart on the platform a force in any desired direction and directed primarily parallel to a surface of the sea due to the buoys on the mooring lines. Example of mooring lines that may not require buoys are taut leg LMS mooring lines that utilize a modified sea floor anchor.

The present invention also provides a tension leg platform (TLP) including a lateral mooring system (LMS), where the LMS includes a plurality of catenary mooring lines anchored to a seabed and attached to the platform, where the LMS is designed to reduce installation and/or operation costs and/or to provide installation and/or operation performance benefits and where the LMS can be attached to the TLP prior to, during or after tendon installation. Preferably, mooring lines are anchored to the seabed in a spaced apart configuration surrounding an installation site of the TLP, include buoys that adjust the vertical component of the mooring line forces acting on the TLP and attached to the TLP in a pattern adapted to allow the LMS to impart on the TLP a force in any desired direction and directed primarily parallel to a surface of the sea due to the action of the buoy on the mooring lines.

The present invention also provides an extended-base, tension leg platform (ETLP) including a lateral mooring system (LMS), where the LMS includes a plurality of catenary mooring lines anchored to a seabed and attached to the platform, where the LMS is designed to reduce installation and/or operation costs and/or to provide installation and/or operation performance benefits and where the LMS can be attached to the ETLP prior to, during or after tendon installation. Preferably, mooring lines are anchored to the seabed in a spaced apart configuration surrounding an installation site of the ETLP, include buoys that adjust the vertical component of the mooring line forces acting on the ETLP and attached to the ETLP in a pattern adapted to allow the LMS to impart on the ETLP a force in any desired direction and directed primarily parallel to a surface of the sea due to the action of the buoy on the mooring lines.

The present invention also provides a tendon-anchored offshore platform including a substructure supporting a deck, a plurality of tendons anchoring the substructure to a seabed under tension and lateral mooring system (LMS) having a plurality of catenary mooring lines anchored to the seabed and attached to the platform, where the LMS is adapted to reduce installation and/or operation costs and/or to provide installation and/or operation performance benefits. Preferably, mooring lines are anchored to the seabed in a spaced apart configuration surrounding an installation site of the platform, include buoys that adjust the vertical component of the mooring line forces acting on the platform and attached to the platform in a pattern adapted to allow the LMS to impart on the platform a force in any desired direction and directed primarily parallel to a surface of the sea due to the buoys on the mooring lines.

The present invention also provides a tension leg platforms (TLP) including a substructure supporting a deck, a plurality of tendons anchoring the substructure to a seabed under tension, and lateral mooring system (LMS) having a plurality of catenary mooring lines anchored to a seabed and attached to the TLP, where the LMS is designed to reduce installation and/or operation costs and/or to provide installation and/or operation performance benefits and where the LMS can be attached to the TLP prior to, during or after tendon installation. Preferably, mooring lines are anchored to the seabed in a spaced apart configuration surrounding an installation site of the TLP, include buoys that adjust the vertical component of the mooring line forces acting on the TLP and attached to the TLP in a pattern adapted to allow the LMS to impart on the TLP a force in any desired direction and directed primarily parallel to a surface of the sea due to the action of the buoy on the mooring lines.

The present invention also provides an extended-base, tension leg platforms (ETLP) including a substructure supporting a deck, a plurality of tendons anchoring the substructure to a seabed under tension, and lateral mooring system (LMS) having a plurality of catenary mooring lines anchored to a seabed and attached to the ETLP, where the LMS is designed to reduce installation and/or operation costs and/or to provide installation and/or operation performance benefits and where the LMS can be attached to the ETLP prior to, during or after tendon installation. Preferably, mooring lines are anchored to the seabed in a spaced apart configuration surrounding an installation site of the ETLP, include buoys that adjust the vertical component of the mooring line forces acting on the ETLP and attached to the ETLP in a pattern adapted to allow the LMS to impart on the ETLP a force in any desired direction and directed primarily parallel to a surface of the sea due to the action of the buoy on the mooring lines.

Methods for Installing an Offshore Platform with Pre-Installed Tendons

The present invention provides a method for installing a tension-anchored offshore platform including the steps of roughly positioning a platform at a desired off-shore site or location. Once roughly positioned, a plurality of seabed anchored lateral mooring lines are attached to the platform. After attaching the mooring lines, the lengths of the mooring lines are adjusted to position and hold the platform on the station (meaning that the platform is maintained substantially at a given position on the surface of the sea or body of water). Once the platform is on station, the platform is ballasted and pre-installed tendons are attached to tendon connectors a base of the platform. After tendon attachment, the platform is deballasted to tension the tendons. After tensioning, the mooring lines may be disconnected, but preferably, the lines are left attached to the platform and are used during post-installation operations to reduce horizontal displacement of the platform due to wind and/or sea currents by adjusting the lengths of the mooring lines to impose a force substantially equal and opposite to the environmental forces acting on the platform. Preferred platforms includes spar platforms, tension leg platforms and extended-base tension leg platforms.

The present invention also provides a method for installing an tendon-anchored offshore platform including the steps of attaching a plurality of temporary stabilization modules to platform and transporting the platform near a desired off-shore site or location. Once the platform is positioned near the desired site, a lateral mooring system including a plurality of seabed anchored lateral mooring lines are attached to the platform. After line attachment, the lengths of the mooring lines are adjusted to position and hold the platform on station. Once the platform is on station, the platform is ballasted and pre-installed tendons are attached to tendon connectors on a base of the platform. After tendon attachment, the platform is deballasted to tension the tendons and the stabilization modules are detached and removed. After tensioning, the mooring lines maybe disconnected, but preferably, the lines are left attached to the platform and are used during post-installation operations to reduce horizontal displacement due to wind and/or sea currents by adjusting the lengths of the mooring lines to impose a force substantially equal and opposite to the environmental forces acting on the platform. Preferred platforms includes spar platforms, tension leg platforms and extended-base tension leg platforms.

Installation of Tension Leg Platforms and Tendons

The present invention provides a method for installing a tendon-anchored offshore platform including the steps of transporting the platform near an installation site. Once positioned near the installation site, a lateral mooring system (LMS) including a plurality of seabed anchored mooring lines are attached to the platform. After LMS attachment, lengths of the lines are adjusted to position the platform over a pre-installed seabed tendon anchor. A tendon is then attached to a working part of a drilling rig associated with a deck of the platform. The tendon is then lowered until a distal end of the tendon having an anchor connector is positioned directly above a tendon connector associated with the tendon anchor. The anchor connector associated with the distal end of the tendon is then stabbed into the anchor with sufficient force so that the anchor connector and the tendon connector lockingly engage to form an installed tendon. Once installed, the lengths of the mooring lines of the LMS are adjusted to position the platform above another pre-installed seabed tendon anchor and the tendon installing process is continued until all tendons have been installed. After tendon installation, the platform can be attached to the tendons as described above for installation of a platform at a site having pre-installed tendons.

Using a Tension Leg Platform Having an LMS for Drilling a Wells at a Site

The present invention provides a method for drilling wells at a desired site using a tendon-anchored offshore platform including the steps of transporting the platform near a drilling, production and installation site. Once positioned near the installation site, a lateral mooring system (LMS) including a plurality of seabed anchored mooring lines are attached to the platform. Once the platform is positioned near the desired site, a lateral mooring system including a plurality of seabed anchored lateral mooring lines are attached to the platform. After line attachment, the lengths of the mooring lines are adjusted to position and hold the platform on station above one of the wells to be drilled. Once the platform is on station, the platform is ballasted and pre-installed tendons associated with the well to be drilled are attached to tendon connectors on a base of the platform. After tendon attachment, the platform is deballasted to tension the tendons and drilling can begin. Once the well is drilled and capped, the platform can be repositioned over a new well via the LMS and the steps are repeated until all the wells associated with the site have been drilled. After well drilling, the platform can be installed in a producing site or repositioned over each well for riser installation and then installed at a producing site, where the riser can be attached for site production. Preferred platforms includes spar platforms, tension leg platforms and extended-base tension leg platforms.

The above apparatuses and methods can also include the use of temporary stabilization modules such as those described in U.S. Pat. No. 6,503,023 and co-pending U.S. patent application Ser. No. 10/284,495, filed 30 Oct. 2002, incorporated herein by reference.

DESCRIPTION OF THE DRAWINGS

The invention can be better understood with reference to the following detailed description together with the appended illustrative drawings in which like elements are numbered the same:

FIG. 4A–D depicts a preferred method for installing a tension leg platform (TLP) having a lateral mooring system (LMS) for a site having pre-installed tendons;

FIG. 5A–D depicts a preferred method for installing a tension leg platform (TLP) having a lateral mooring system (LMS) including installing of tendons using the TLP and associated LMS for a site having pre-installed tendon anchors.

DETAILED DESCRIPTION OF THE INVENTION

Figure 1B:
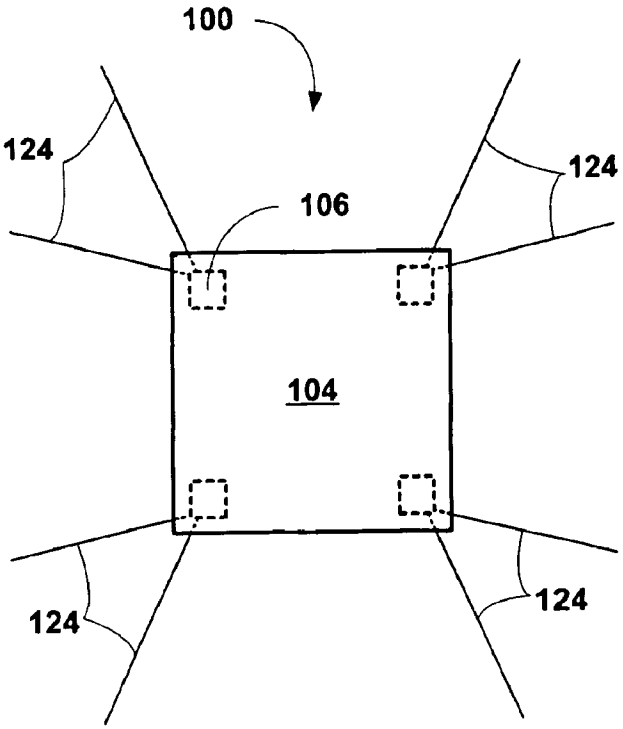
FIG. 1B depicts a top view looking down at a wing of the extended-base tension leg platform of FIG. 1A evidencing the distribution of tendons and lateral mooring lines associated with each wing and corner of the platform.

The inventors have found that a new mooring system specifically tailored to the unique features of offshore platforms especially tension leg platforms (TLPs) and extended-base tension leg platforms (ETLPs) can be constructed, where the system reduces costs associated with installation and/or operation of the platforms and provides multiple installation and/or operation performance benefits. The new mooring systems of this invention include both a tension leg mooring system and a lateral mooring system (LMS) and are well-suited for mild metocean conditions, such as those offshore W Africa and Brazil, but may also find application in oceanic regions having more severe conditions.

A substantial portion of the costs of using an TLP or ETLP for offshore operations is related to their installation. Costs associated with heavy lift crane vessels represent a major share of the installation costs. Using the LMS systems of this invention can reduce or even eliminate the need for the heavy lift crane vessels during installation, thus, making TLPs and ETLPs a more attractive commercial offering for offshore installations subject to mild metocean conditions or even more severe oceanic conditions.

The LMS of this invention can be adjustable at need or can be made dynamic, i.e., the system would continually adjust lengths of the mooring lines to maintain the platform in a substantially zero net force condition. To make the LMS dynamic, each mooring line attachment system at the platform (the winches, winch motors and the winch controllers) are equipped with force sensors such as strain gauges or the like as are the tendons. The output of these force sensors are input to an analog processing unit (APU) and/or digital processing unit (DPU) via a hard wired or wireless communication system. The APU and/or DPU receives force information from each force sensor continuously or periodically and adjusts the lengths of the mooring lines to maintain a desired platform configuration or to maintain the platform in a substantially zero-net-force condition on a periodic or continuous basis. Thus, the LMS can be used as a dynamic force compensation system during standard operation or during adverse weather and sea conditions and/or events.

Suitable APU include, without limitation, any analog circuitry capable of receiving and processing input signals and capable of producing and sending output signals, where the input signals represent force measurements and the output signals represent control signals for the mooring lines. Suitable DPU include, without limitation, any digital circuitry capable of receiving and processing input signals and capable of producing and sending output signals, where the input signals represent force measurements and the output signals represent control signals for the mooring lines. Preferred DPU include, without limitation, computers and computer systems including a processing unit made but such manufacturers a Intel, Sun Microsystems, Motorola, IBM, Compaq, HP, or other manufacturers. The APUs and/or DPUs can be a single unit or a collections of units linked together via a communication system using standard hardware and software. The APUs and/DPUs can also include standard and yet to be invented peripherals including user interfaces, displays devices, storage devices, memory, buses between processing unit or any other type of peripheral.

Suitable force sensor include, without limitation, strain gauges, pneumatic gauges, hydraulic gauges, load cells or any other sensor capable of measuring for force, magnitude alone or magnitude and direction.

Offshore Platforms with a Lateral Mooring System

The present invention broadly relates to an offshore platforms including a tension mooring system and a lateral mooring system (LMS). The tension mooring system includes a plurality of tendons anchored to a seabed and attached to the platform designed to hold the platform on station at a given oceanic site in a tensioned configuration. The LMS includes a plurality of lateral catenary mooring lines anchored to a seabed and attached to the platform designed to reduce installation and/or operation costs and to provide installation and/or operation performance benefits. Preferably, the platform is a tension leg platform or a extended-base tension leg platform, but cylindrical spar or other tensioned platforms can be used as well.

Preferably, the seabed ends of the mooring lines are anchored to the seabed at anchor points distributed in a space apart configuration about a center point of the site, where the configuration is designed to allow the position of the platform to be changed during installation and/or operations about a region surrounding the installation site. For platforms that can be inscribed by a circle centered at the center point of the site, the spaced apart configuration comprises anchor points preferably distributed in a spaced apart configuration about a circle concentric with the inscribing circle, i.e., having the center point as its center, and extending out a sufficient distance to achieve a desired range of platform motion about the center point of the site and/or to achieve a desired line orientation for platform installation and/or operations.

For rectangular or oval-shaped platforms, the anchor points of the lines are preferably distributed about either an ellipse centered at the center point of the site, a circle centered at the center point of the site or two circles centered at a middle point of the two short sides of the platform as if the platform were properly tensioned at on station over the center point of the site. In all these distributions of the anchor points are distributed about the ellipse or circle or circles in a spaced apart configuration, and extending out a sufficient distance to achieve a desired range of platform motion about the center point of the site and/or to achieve a desired line orientation for platform installation and/or operations.

Preferably, the platform ends of the mooring lines attach to the platform in a configuration sufficient to permit the platform to be moved in any direction quickly and efficiently simply by changing the lengths of some or all of the mooring lines simultaneously. For example, if the platform includes three columns arranged in a triangular arrangement, then mooring lines are preferably attached to the platform by passing the lines through guides associated with each column and connected to line control units on the deck of the platform or associated with a portion of the platform substructure above the water line. For four column platform in a quadrilateral configuration (square, rectangular or general quadrilateral), the mooring lines are again preferably attached to the platform by passing the lines through guides associated with each column and connecting to line control units either on the deck of the platform or associated with the portion of the platform substructure above the water line. For platforms with more the four columns, the mooring lines attach to the platform at the columns in a manner similar to the manner set forth above. Preferably, two mooring lines are associated with each column in a V-shaped configuration. For cylindrical platforms, the mooring lines are attached at equally spaced points about the cylindrical exterior of the platform. Preferably, pair of lines emanate from each point in a V-shaped configuration.

Although it is preferred to have the mooring lines attached to the platform at the columns because the guides can be secured to an above water line portion of each column, the mooring lines can also be attached to the platform at other locations such as in a middle portion of the sides of the platform at any other part of the platform not associated with the columns which are generally located at vertices of the platform shape. In both the vertex moored configuration or column moored configuration and the side moored configuration (lines anchored at any site other than the columns), there should be sufficient mooring lines so that platform positioning during installation can be achieve quickly and easily either during installation or to achieve force compensation during operation to maintain the platform in a substantially force free state.

The mooring lines generally include a buoy which allows the mooring lines to impart a greater horizontal force to the platform than would be the case if the lines did not have a buoy associated therewith. The lines used in this invention can be metal, composite or polymeric or combinations thereof depending on the application, cost and other factors. Preferred metals include, without limitation, steels or other iron alloys or combinations thereof. Preferred composites include, without limitation, carbon fiber or aramide composites or combinations thereof. Preferred polymeric lines include, without limitation, multi-stranded polyester, polyamide, or the like or combinations thereof. Preferably, the lines are sea water resistant, steel cables or polyester or polyamide cables or combinations thereof.

The mooring lines are controlled at their platform ends by line take-up and let-out systems installed either on the deck of the platform or in or on a portion of the substructure above the water line. The control systems can be manually controlled or computer controlled and either control format can include remote control depending on the installation requirements. Generally, the line control systems are winches with motors to control take-up and let-out. These winches can controlled by a digital and/or analog processing unit so that all the winches can be adjusted simultaneously and/or dynamically.

For dynamic control, the computer (DPUs and/or APUs and/or system of APUs and/or DPUs) would need data concerning the length of each line, forces acting on each line, and horizontal forces acting on the platform. The forces acting on the lines can be determined either directly from the winch or via force measuring devices or sensors attached to the winch and/or to the lines. The forces acting on the platform can be determined by force sensing devices or sensors attached to or associated with the tendons, with the tendon porches where the tendons attach to the platform or with the feet of the tendons where the tendons anchor to the seabed or any combination thereof. By determining the forces acting on the tendons, the computer determines a direction and magnitude of a composite force acting on the entire platform.

After determining the direction and magnitude of the composite force, the computer determines adjustments to the length of the mooring lines to produce a force of substantially equal magnitude to the composite force, but in a direction substantially opposite the direction of the composite force. Adjustment continues until the platform is in a substantially zero-force state. Of course, the computer can either continuously or periodically monitor the force sensors and adjust the lines accordingly. Such dynamic control would require variable speed winch motors and a robust communication system between the computer, the force sensor and the line controllers.

Platform Installation Using an LMS

The present invention also broadly relates to methods for installing tendon anchored, offshore platforms. One preferred method for platform installation at a site having a pre-installed tensioning system including a plurality of pre-installed, seabed anchored tendons and a pre-installed lateral mooring system (LMS) including a plurality of seabed anchored mooring lines, involves transporting the platform at a desired offshore site or location via ship or tugs or the like. After transportation, the LMS is attached to the platform and the lengths of the mooring lines are adjusted to place and hold the platform on station over the site for tendon connection. The platform is then ballasted and the tendons attached to tendon connectors associated with a bottom portion of the platform substructure such as a tendon porch. After tendon connection, the platform is deballasted until a desired tendons tension is achieved completing platform installation. After installation, the LMS can be removed, but preferably the LMS is not removed and is used to maintain the platform in a substantially zero-force condition.

Another preferred method, designed for platform installation at a site having a plurality of pre-installed tendon anchors and a pre-installed lateral mooring system (LMS) including a plurality of mooring lines, involves transporting the platform to a desired offshore site or location via ship or tugs or the like. After transportation, the LMS is attached to the platform and the lengths of the mooring lines are adjusted to place and hold the platform on station over one of the pre-installed tendon anchors. A tendon is then attached to the working end of a drilling rig associated with a deck of the platform. The attached tendon includes a tendon anchor connector at is distal end and a tendon buoyancy module connect at or near its proximal end and the tendon anchor includes a tendon connector, where the two connectors are designed to lockingly engage each other anchoring the tendon to the tendon anchor. The distal end of the tendon is then lowered or directed to tendon anchor and stabbed into the tendon anchor with sufficient force to permit the two connectors to lockingly engage anchoring the tendon. The platform is then positioned and held on station over the next tendon anchor and another tendon is stabbed into place. After all of the tendons have been installed, the site now is equivalent to a site having a pre-installed tendons. As stated above, the platform is then positioned on station over the installation site and ballasted so that the tendons can be attached to tendon connectors associated with a bottom portion of the platform such as a tendon porch and deballasted until a desired tendon tension is achieved completing platform installation.

The present above method can also include the steps of attaching a plurality of temporary stabilization modules to the platform in a module spaced apart configuration either before or after transportation, but before platform and/or combined tendon/platform installation. The temporary stabilization modules are then be removed after tendon tensioning.

Site Drilling Using a Moveable Tendon-Based Platform Having an LMS

Another preferred method using an LMS attached to a tendon-based offshore platform is designed to allow the tendon-based offshore platform to be used as a repositionable drilling platform for an oceanic site, which is intended to have a plurality of producing wells. The method involves transporting the platform to a desired offshore site or location via ship or tugs or the like. After transportation, the LMS is attached to the platform and the lengths of the mooring lines are adjusted to place and hold the platform on station over one of the well sites to be drilled. Each well site can either include pre-installed tendons for direct platform attachment or pre-installed tendon anchors which can be used to install tendons at the site. In either case, after tendon attachment and platform tensioning, a well is drilled at the site. After the well is drilled and capped, with or without riser attachment, the platform is deinstalled by ballasting the platform, disconnected from the tendons, which can be recovered if the tendons are releasably connected to the tendon anchors, and using the LMS to reposition the platform over the next well site. This process is continued until all of the well are drilled. After all well are drilled, the platform can be repositioned above each site for riser installation. Finally, the platform can be repositioned to its permanent production site and installed. After permanent installation, the risers can be attached to the platform converting the platform into a production platform.

ILLUSTRATIVE PREFERRED EMBODIMENTS

The following detailed description of the drawings associated with this invention are included to illustrate preferred embodiments of this invention, but are not intended to limit the scope of this invention.

Tendon-Based Offshore Platforms Having an LMS

Figure 1A:
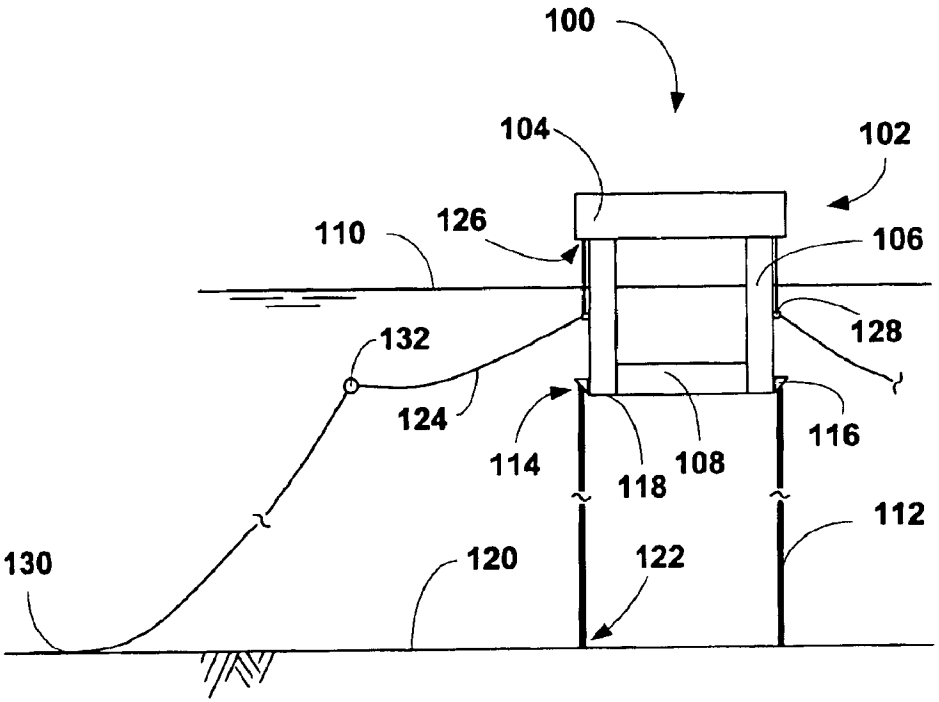
FIG. 1A depicts a side view of a preferred embodiment of a tension leg platform including tendons and lateral mooring lines.

Referring now to FIGS. 1A&B, a preferred tension leg, laterally moored, platform (LMS-TLP), generally 100, of this invention is shown to include a tension leg platform 102 having a deck 104 columns 106, pontoons 108, where the deck 104 is located above a water line 110. Tendons 112 are attached at their platform ends 114 to tendon porches 116 associated with a distal end 118 of each column 106 and anchored to a seabed 120 at their seabed ends 122. Two lateral mooring lines 124 are attached to each column 106 at their platform ends 126 to guides 128 and to the seabed 120 at their seabed ends 130 having a catenary buoy 132 interposed therebetween.

On board winches (not shown) control the mean static position, or offset, of the TLP 100. The off-board components (e.g., lines, piles and buoys) of the mooring lines can be installed prior to arrival of the TLP 100. Mooring line piles can be installed at the same time as the tendon piles and FPSO piles, making installation a single operation. Although the TLP 100 is anchored to the seabed in the traditional way using seabed anchored tendons to tension the platform, the lateral mooring lines are useful for installing the TLP 100 by holding the TLP 100 stationary during tendon installation, during well drilling, during riser installation, during production off-loading and during any other operation that requires some amount of TLP repositioning or force compensation to maintain the TLP in a substantially vertical orientation and/or substantially zero-force condition. The term substantially vertical means that the TLP is oriented in a manner that a horizontal off-set is less than the maximum amount of horizontal off-set the TLP is designed to withstand.

Figure 2B:
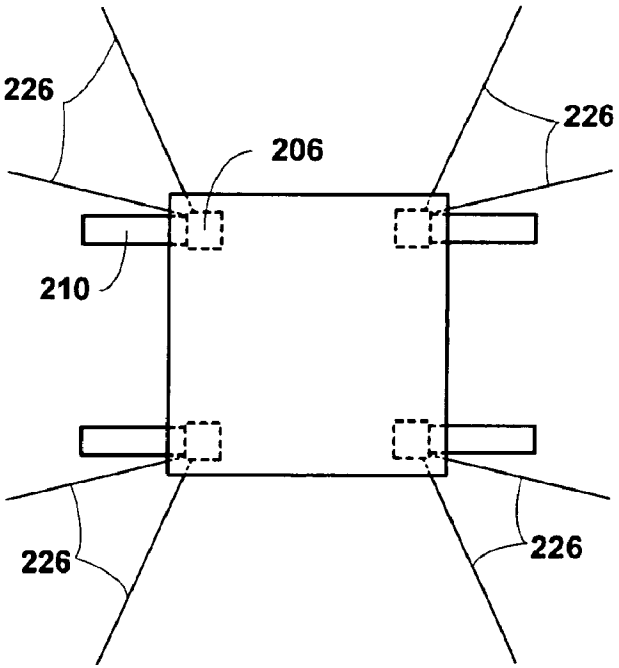
FIG. 2B depicts a top view looking down at a wing of the extended-base tension leg platform of FIG. 2A evidencing the distribution of tendons and lateral mooring lines associated with each wing and corner of the platform.
Figure 2A:
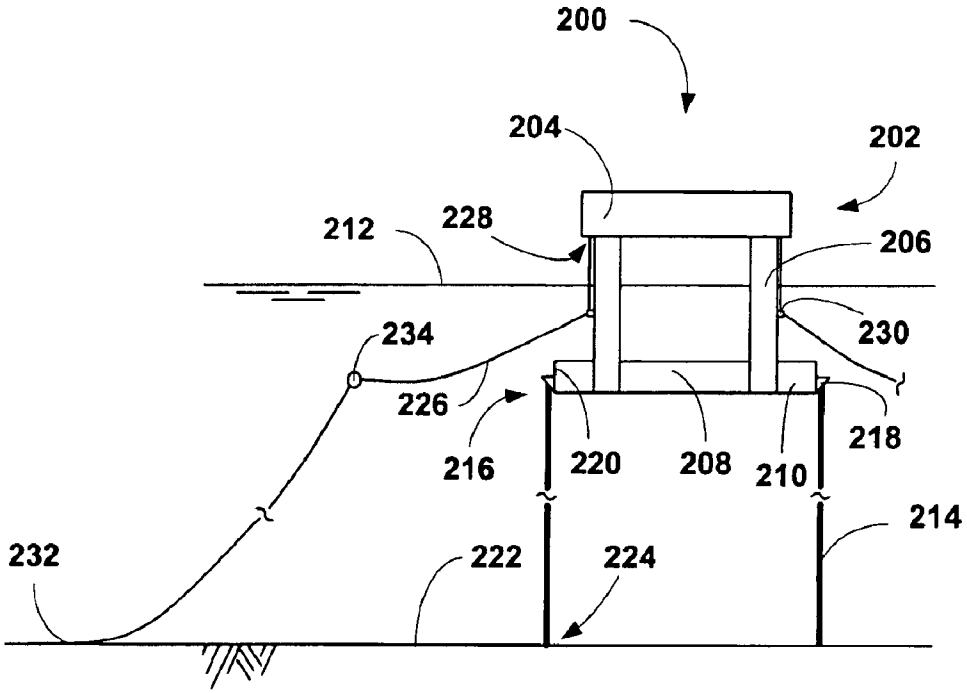
FIG. 2A depicts a side view of a preferred embodiment of an extended-base tension leg platform including tendons and lateral mooring lines.

Referring now to FIGS. 2A&B, a preferred extended-base tension leg, laterally moored, platform (LMS-ETLP), generally 200, of this invention is shown to include a tension leg platform 202 having a deck 204, columns 206, pontoons 208, and base extensions or wings 210, where the deck 204 is located above a water line 212. Tendons 214 are attached at their platform ends 216 to a tendon porch 218 associated with a distal end 220 of each column 206 and are anchored to a seabed 222 on their seabed ends 224. Two lateral mooring lines 226 are attached, at their platform ends 228, to guides 230 associated with each column 206 and to the seabed at their seabed ends 232 with a catenary buoy 234 interposed therebetween. On board winches (not shown) control the mean static position, or offset, of the ETLP. The off-board components (e.g., pile and buoy) of the LMS can be installed prior to arrival of the ETLP. LMS piles can be installed with the FPSO piles.

On board winches (not shown) control the mean static position, or offset, of the ETLP 200. The off-board components (e.g., lines, piles and buoys) of the mooring lines can be installed prior to arrival of the ETLP 200. Mooring line piles can be installed at the same time as the tendon piles and FPSO piles, making installation a single operation. Although the ETLP 200 is anchored to the seabed in the traditional way using seabed anchored tendons to tension the platform, the lateral mooring lines a useful for installing the ETLP 200 by holding the ETLP 200 stationary during tendon installation, during well drilling, during riser installation, during production off-loading and during any other operation that requires some amount of ETLP repositioning or force compensation to maintain the ETLP in a substantially vertical orientation. The term substantially vertical means that the ETLP is oriented in a manner that a horizontal off-set is less than the maximum amount of horizontal off-set the ETLP is designed to withstand. Tension control of the LMS lines assists the ETLP tendons maintain an acceptable horizontal offset, which for some ETLPs is about 4%, allowing 100% operability during the ETLPs lifetime. As a result, tendon pretension can be reduced. A favorable consequence of pretension reduction is less hull steel and tendon downsizing.

Figure 3B:
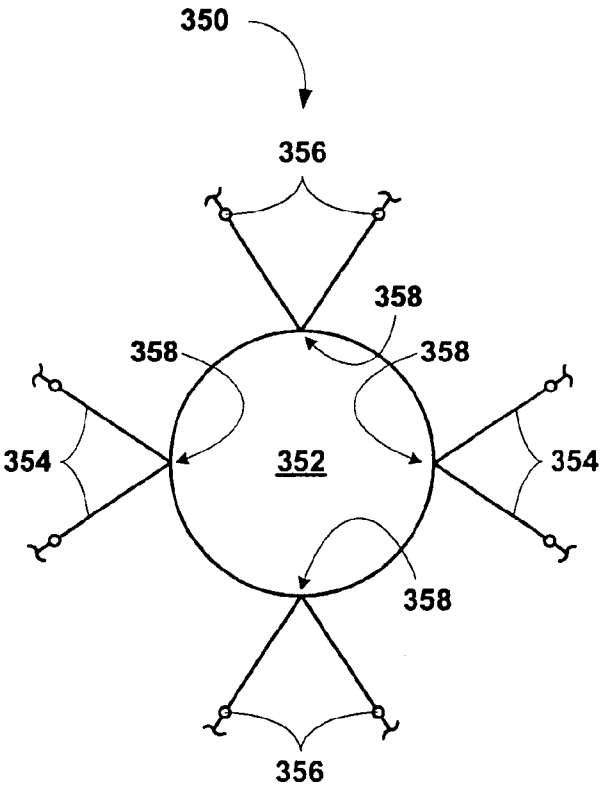
FIG. 3B depicts a top view of a preferred embodiment of a circular tension leg platform including tendons and lateral mooring lines.
Figure 3A:
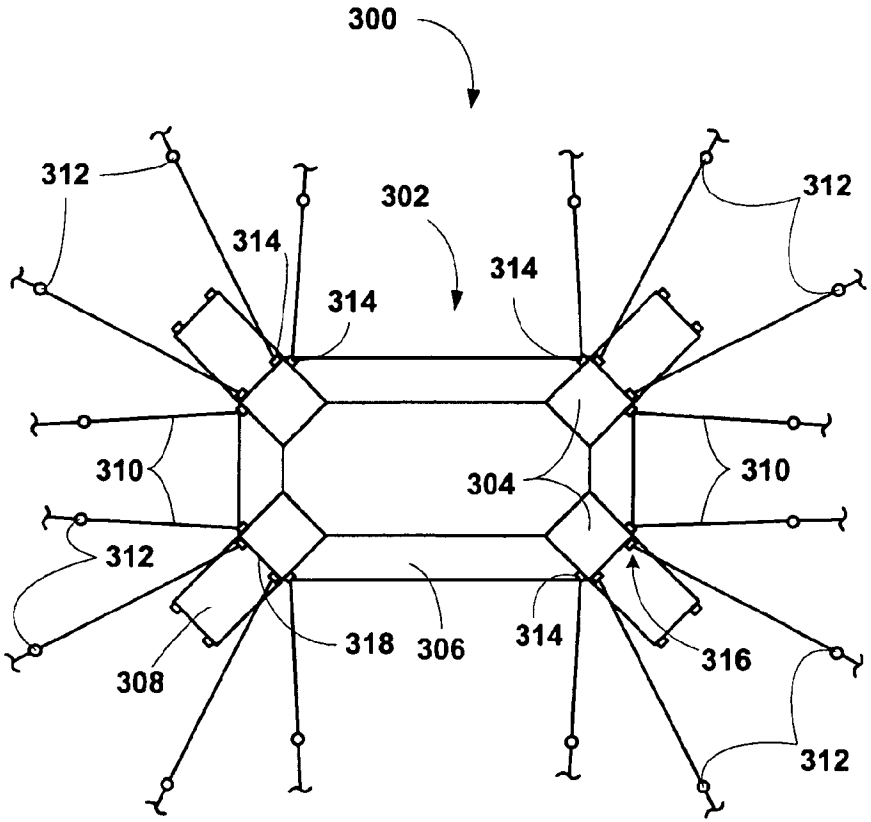
FIG. 3A depicts a top view of another preferred embodiment of an extended-base tension leg platform including tendons and lateral mooring lines.

Referring now to FIG. 3A, another preferred LMS-ETLP, generally 300, of this invention is shown to include a tension leg platform substructure 302 having columns 304, pontoons 306, and base extensions or wings 308. Four lateral mooring lines 310 with associated buoys 312 are attached to guides 314 associated with each column 304 at their platform ends 316. Two of the lines 310 are attached to guides 314 on an outer face 318 of each column 304 above the wings 308.

Referring now to FIG. 3B, another preferred LMS-TLP, generally 350, of this invention is shown to include a circular tension leg platform substructure 352 having two lateral mooring lines 354 with associated buoys 356 attached at four locations 358 of the substructure 352.

Again, on board winches (not shown) control the mean static position, or offset, of the substructures 300 and 350, and the off-board components (e.g., lines, piles and buoys) of the mooring lines can be installed prior to arrival of the substructures.

Installation of Tension Leg Platforms Having Pre-Installed Tendons

Referring now to FIGS. 4A–D, the LMS of this invention can be used to assist in TLP or ETLP installation allowing the TLP or ETLP to be quickly and effectively positioned and repositioned for tendon attachment and tensioning. Looking at FIG. 4A, an ETLP, generally 400, is shown to floating in a body of water 402 having a surface 404 and a bed 406 and a first position 408. The ETLP 400 includes a deck 410 having a drilling rig 412 and a substructure 414 having columns 416, pontoons 418, wings 420, tendon connectors 422 and a mooring lines 424, only two of which are shown. The mooring lines 424 include a buoy 426, are attached to the ETLP 400 via guides 428 terminating in winches (not shown) located in the deck section 410 of the ETLP 400 and are anchored to the seabed 406 at an anchors 430.

Looking at FIG. 4B, by changing the lengths of the mooring lines 424, the ETLP 400 can be repositioned to a second position 432 where at least one tendon connector 422 lines up with a top connector 434 of at least on pre-installed tendon 436. Looking a FIG. 4C, the ETLP 400 is kept at the position 432 by the mooring lines 424, while the ETLP 400 is being connected to the tendons 436 via the top connectors 434 and the tendon connectors 422, ballasted and debal-lasted to tension the tendons 436. Of course, the lengths of the mooring lines 424 may need to be adjusted during this operation to change or adjust the position of the ETLP 400 so that each tendon connector 422 can be connected to its corresponding top connector 434 on its associated tendon 436. Looking at FIG. 4D, the ETLP 400 is shown fully installed and tensioned.

Installation of Tension Leg Platforms and Tendons

Referring now to FIGS. 5A–D, the LMS of this invention can be used to assist in TLP or ETLP installation allowing the TLP or ETLP to be quickly and effectively positioned and repositioned for tendon installation, attachment and tensioning. Looking at FIG. 5A, an ETLP, generally 500, is shown floating in a body of water 502 having a surface 504 and a bed 506 at a first position 508. The ETLP 500 includes a deck 510 having a drilling rig 512 and a substructure 514 having columns 516, pontoons 518, wings 520, tendon connectors 522 and a mooring lines 524, only two of which are shown. The mooring lines 524 include a buoy 526, are attached to the ETLP 500 via guides 528 terminating in winches (not shown) located in the deck section 510 of the ETLP 500 and are anchored to the seabed 506 at an anchor 530. The first position 508 is in proximity of a plurality of tendon anchors 532 having a tendon connector 534 located on the seabed 506.

The ETLP 500 also includes a tendon 536 having a tendon anchor connector 538 at its distal end 540 and tendon buoy module 541. The tendon 536 is attached to a cable or wire line 542 connected to the working part (not shown) of the rig 512 so that the tendon 536 can be lowered to one of the tendon anchors 532 for tendon installation. Once lowered to a tendon anchor 532, the tendon anchor connector 538 stabs into the tendon connector 534 associated with the anchor 532 to form an installed tendon. Of course, the stabbing force mus be sufficient enough to lock the tendon 536 in place and the connectors 534 and 538 must lock with sufficient rigidity to withstand platform tensioning and normal post installation force fluctuations.

Looking at FIG. 5B, by changing the lengths of the mooring lines 524, the ETLP 500 is repositioned to a second position 544 where the tendon 536 lines up with one of the tendon anchors 532. The cable 542 connecting the tendon 536 to the working part of the rig 512 is then lowered until the tendon anchor connector 538 is stabbed into the anchor 532 with sufficient force to cause the tendon connector 534 of the anchor 532 to lockingly engage the connector 538 of the tendon 536. Looking a FIG. 5C, the tendon installation process is repeated by attaching another tendon 536 to the working part of the rig 512, repositioning the ETLP 500 to a third position 546 by adjusting the lengths of the mooring lines 524, and stabbing the tendon 536 into the anchor 532 with sufficient force to cause the tendon connector 534 of the anchor 532 to lockingly engage the connector 538 of the tendon 536.

After all of the tendons 536 have been installed by the above described repositioning and stabbing process, the ETLP 500 is repositioned to an installation position 548 as shown in FIG. 5D. The tendon buoy modules 541 are removed and ETLP 510 is lowered in the water and top tendon connectors 550 are connected to the platform tendon connectors 522. The ETLP 510 is then raised to installation depth tensioning the tendons 536 completing the installation process.

Thus, the mooring lines associated with the tension leg platforms of this invention are used to winch the free floating TLP or ETLP over the first pre-installed tendon pile with associated seabed connector. The drilling rig is then be used to vertically stack the tendon sections one by one to form a tendon having an anchor connector at its bottom. The fully assembled tendon with tendon buoyancy module fits easily through the open wellbay. When fully assembled, the tendon string is then stabbed into the connector associated with the pre-installed tendon pile or anchor and left free-standing. This procedure is repeated for the remaining seven tendons, for an eight tendon tension leg platform. This tendon installation procedure is performed without the need of a heavy lift crane vessel.

Having installed all of the tendons, the ETLP accurately positions itself with the LMS. The tendon tops are pulled aside and ballasting of the ETLP is begun. When lock-off draft is achieved, the tendons are allowed to return back to vertical and are guided into the side-entry porches. Debal-lasting is begun and continues until the proper tendon pretension level is reached. After final tension adjustments are made the ETLP is weathersafe. Temporary stability modules and tendon buoyancy modules are removed and the ETLP is ready for operation. Again, this ETLP self-installation procedure just described is performed without the need of a heavy lift crane vessel.

LMS Assisted TLP Site Drilling

Figures 6A, 6B, 6C:
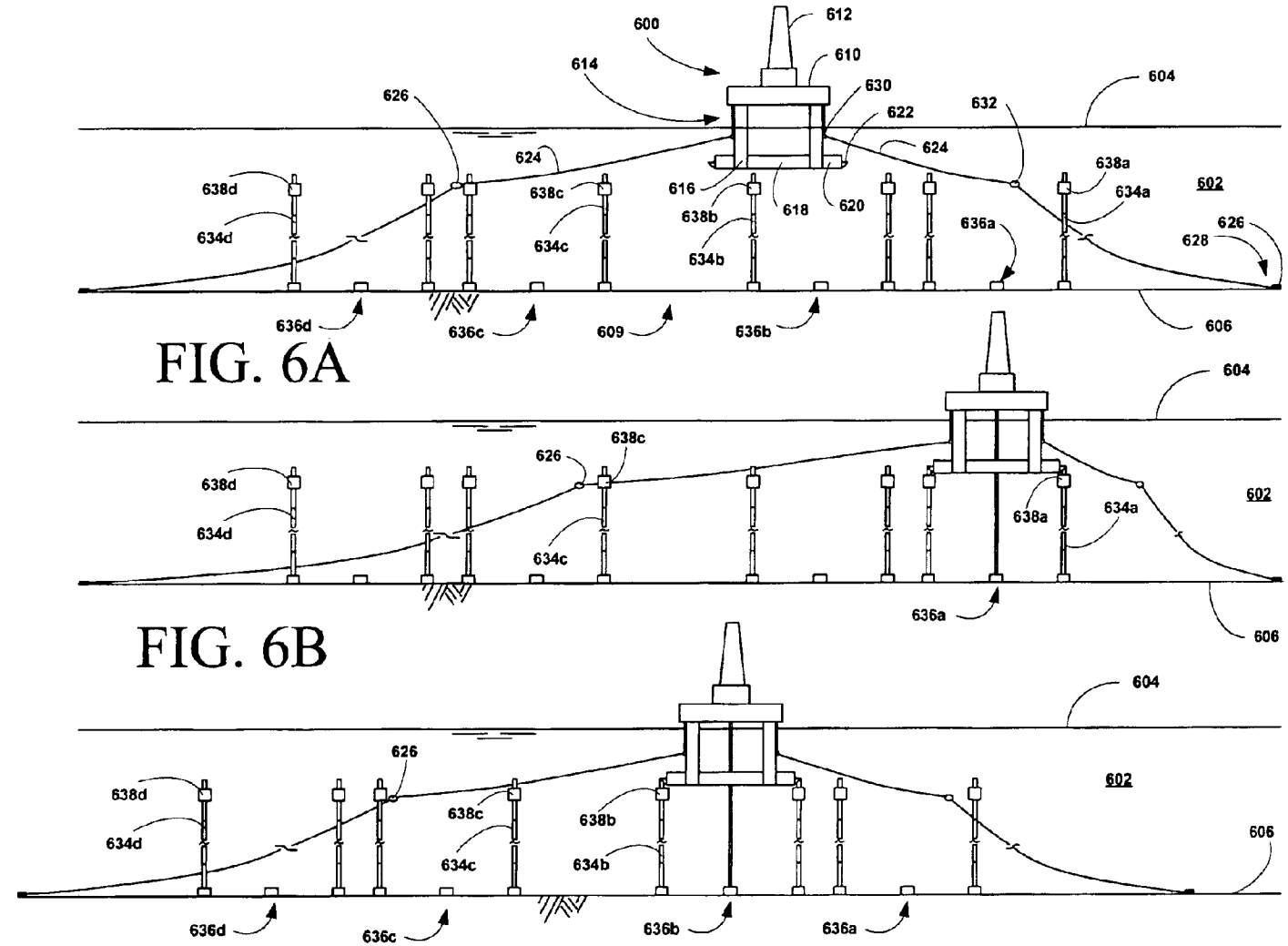
FIG. 6A–C depicts a preferred method for drilling fields using a tension leg platform (TLP) having a lateral mooring system (LMS) including installing of tendons using the TLP and associated LMS for a site having pre-installed tendon at each drilling site.

Referring now to FIGS. 6A–C, an LMS of this invention is used to assist an TLP or ETLP in drilling or completing an offshore oil field having a plurality of subsea wells. Looking at FIG. 6A, an ETLP, generally 600, is shown floating in a body of water 602 having a surface 604 and a bed 606 over a drilling site 608. The ETLP 600 includes a deck 610 having a drilling rig 612 and a substructure 614 having columns 616, pontoons 618, wings 620, tendon connectors 622 and a mooring lines 624, only two of which are shown. Each mooring line 624 extend from a seabed anchor 626 at its distal end 628 to the ETLP 600 via guides 630 to winching systems (not shown) located on the deck 610 or in the substructure 614 above the water surface 604. Each mooring line 624 also includes a buoy 632 positioned along the line 624.

After the ETLP 600 attachment of the mooring lines 624, the ETLP 600 can be repositioned over a plurality of pre-installed tendons 634*a–d* associated with locations 636*a–d* on the seabed 606, which can correspond to either drilling sites or pre-existing wellheads that require riser installation. The tendons 634*a–d* has buoyant modules 638*a–d* associated therewith. The mooring lines 624 are used position the ETLP 600 over each location 636*a–d* so that a well can be drilled or a riser can be installed. Looking at FIG. 6B, the mooring lines 624 are used to position the ETLP 600 over the location 636*a* and the ETLP 600 is then installed using the pre-installed tendons 634*a* associated with the site 636*a* as shown in FIG. 6B. Once installed at the site 636*a*, the ETLP 600 is used to drill a well as shown in the figure at the site 636*a*. After drilling is completed at site the 636*a*, the ETLP 600 is deinstalled from the pre-installed tendons 634*a* and positioned over the site 636*b* via the mooring lines 624. Once positioned over the site 636*b*, the ETLP 600 is installed over the site 636*b* using the pre-installed tendons 634*b* associated therewith and a well is drilled at that site as shown in FIG. 6C. This process is continued until wells are drilled at all of the sites 636*a–d* using the mooring lines 624 and the pre-installed tendons 634*a–d* associated with each site. Of course, for well distribution patterns of this invention, the number of wells and their layout would be consistent with a closely packed perimeter production platform which can be the ETLP itself or a secondary installation to be installed later.

It should be recognized by an ordinary artisan that the above process does not need to utilize pre-installed tendons. Utilizing the process described in connection with FIG. 6A–C, the ETLP or TLP can be used to installed the tendons at piles sites associated with each drilling site in the drilling pattern. If the tendons are also disconnectable, then the tendons can be installed and deinstalled and reinstallated at each new drilling site so that only one set of tendons is left after field complete and riser installation.

Utilizing a LMS allows the ETLP to winch itself directly over the seafloor wellhead similar to a Spar platform. The drilling rig can be fixed in the middle of the open wellbay. Since a skidable rig is no longer necessary, a majority of trim ballast can be eliminated. A favorable consequence of trim ballast reduction is less hull steel and tendon downsizing. In addition, a substantial amount of steel can be removed from the rig's substructure. Guidelines and associated equipment can also be eliminated.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method of deploying a tension-anchored platform, comprising:

(a) positioning a platform at a position that is laterally offset from a desired subsea location for a subsea well;

(b) attaching a plurality of seabed anchored lateral mooring lines to the platform;

(c) moving the platform laterally to a position above the desired subsea location of the subsea well by selectively tightening and loosening the plurality of the mooring lines; and then (d) connecting a plurality of tendons to a lower portion of the platform.

2. The method of claim 1, further comprising:

prior to step (d), providing a plurality of preinstalled tendons, each of the preinstalled tendons having a distal end connected to a tendon anchor located at the seabed; and ballasting the platform so the platform is in a position to connect the platform to a proximal end of each of the plurality of tendons.

3. The method of claim 1, further comprising:

prior to step (c):

(i) providing a plurality of preinstalled tendon anchors located at the seabed;

(ii) moving the platform to a position laterally above one of the preinstalled tendon anchors by selectively tightening and loosening the plurality of the mooring lines;

(iii) anchoring a proximal end of a tendon to the preinstalled tendon anchor positioned below the platform by lowering a tendon with a derrick located on the platform; and then (iv) repeating steps (ii)–(iii) until each a tendon has been anchored to each preinstalled tendon anchor.

4. The method of claim 3, further comprising:

prior to step (d), ballasting the platform so the platform is in a position to connect the platform to a proximal end of each of the plurality of tendons.

5. The method of claim 1, further comprising:

prior to step (d), ballasting the platform to lower the platform to an elevation for connecting to the tendons;

and following step (d):

(e) deballasting the platform to tension the tendons; and (f) selectively adjusting a length of the each of the mooring lines responsive to sea conditions in order to hold the platform above the desired subsea location of the subsea well by selectively tightening and loosening the plurality of the mooring lines.

6. The method of claim 1, further comprising:

(e) providing a second desired subsea location for a second subsea well that is spaced-apart from the first desired position of the first subsea well a distance that is greater than the distance the platform can laterally move while being connected to the tendons associated with the first subsea well;

(f) disconnecting the platform from the tendons associated with the first subsea well;

(g) moving the platform laterally to a position above the second desired subsea location of the second subsea well by selectively tightening and loosening the plurality of the mooring lines; and then (h) connecting a plurality of tendons associated with the second subsea well to a lower portion of the platform.

7. A method of deploying a tension-anchored platform, comprising:

(a) positioning a platform at position that is offset laterally from a desired subsea location for a subsea well;

(b) attaching a plurality of seabed anchored lateral mooring lines to the platform;

(c) moving the platform laterally to a position above the desired subsea location of the subsea well by selectively tightening and loosening the plurality of the mooring lines;

(d) ballasting the platform to lower the platform to an elevation for connecting to a plurality of tendons connected to the seabed;

(e) connecting the plurality of tendons to a lower portion of the platform.

(f) deballasting the platform to tension the tendons; and (g) selectively adjusting a length of the each of the mooring lines responsive to sea conditions in order to hold the platform above the desired subsea location of the subsea well by selectively tightening and loosening the plurality of the mooring lines.

8. The method of claim 7, further comprising:

prior to step (d), providing a plurality of preinstalled tendons, each of the preinstalled tendons having a distal end connected to a tendon anchor located at the seabed.

9. The method of claim 7, further comprising:

prior to step (c):

(i) providing a plurality of preinstalled tendon anchors located at the seabed;

(ii) moving the platform to a position laterally above one of the preinstalled tendon anchors by selectively tightening and loosening the plurality of the mooring lines;

(iii) anchoring a proximal end of a tendon to the preinstalled tendon anchor positioned below the platform by lowering a tendon with a derrick located on the platform; and then (iv) repeating steps (ii)–(iii) until each a tendon has been anchored to each preinstalled tendon anchor.

10. The method of claim 7, further comprising:

(g) providing a second desired subsea location for a second subsea well that is spaced-apart from the first desired position of the first subsea well a distance that is greater than the distance the platform can laterally move while being connected to the tendons associated with the first subsea well;

(h) disconnecting the platform from the tendons associated with the first subsea well;

(i) moving the platform laterally to a position above the second desired subsea location of the second subsea well by selectively tightening and loosening the plurality of the mooring lines;

(j) ballasting the platform to lower the platform to an elevation for connecting to a plurality of tendons associated with the second subsea well;

(k) connecting the plurality of tendons associated with the second subsea well to a lower portion of the platform.

(l) deballasting the platform to tension the tendons associated with the second subsea well; and (m) selectively adjusting a length of the each of the mooring lines responsive to sea conditions in order to hold the platform above the desired subsea location of the second subsea well by selectively tightening and loosening the plurality of the mooring lines.

11. A method of installing a tension-anchored platform, comprising:

(a) providing a plurality of desired subsea locations for a plurality of subsea wells;

(b) positioning a platform at a preliminary position that is laterally offset from a first one of the desired subsea locations for a first one of the subsea wells;

(c) attaching a plurality of seabed anchored lateral mooring lines to the platform;

(d) moving the platform laterally from the preliminary position to a first position above the first desired subsea location of the first subsea well by selectively tightening and loosening the plurality of the mooring lines;

(e) connecting a plurality of tendons associated with the first desired subsea location of the first subsea well to a lower portion of the platform;

(f) disconnecting the platform from the tendons associated with the first desired subsea location of the first subsea well;

(g) moving the platform laterally a distance that is greater than the distance the platform can laterally move while being connected to the tendons associated with the first desired position of the first subsea well, to a second position above a second desired subsea location of a second subsea well; and then (h) connecting a plurality of tendons associated with the second desired subsea location of the second subsea well to a lower portion of the platform.

12. The method of claim 11, further comprising:

prior to step (e), providing a plurality of preinstalled tendons, each of the preinstalled tendons having a distal end connected to a tendon anchor located at the seabed; and ballasting the platform so the platform is in a position to connect the platform to a proximal end of each of the plurality of tendons associated with the first desired subsea location of the first subsea well.

13. The method of claim 11, further comprising:

prior to step (h), providing a plurality of preinstalled tendons, each of the preinstalled tendons having a distal end connected to a tendon anchor located at the seabed; and ballasting the platform so the platform is in a position to connect the platform to a proximal end of each of the plurality of tendons associated with the second desired subsea location of the second subsea well.

14. The method of claim 11, further comprising:

prior to step (e):

(i) providing a plurality of preinstalled tendon anchors located at the seabed associated with each of the desired subsea locations for a plurality of subsea wells;

(ii) moving the platform to a position laterally above one of the preinstalled tendon anchors associated with the first subsea well by selectively tightening and loosening the plurality of the mooring lines;

(iii) anchoring a proximal end of a tendon to the preinstalled tendon anchor positioned below the platform by lowering a tendon with a derrick located on the platform;

(iv) repeating steps (ii)–(iii) until each a tendon has been anchored to each preinstalled tendon anchor; and then (v) repeating steps (i)–(iv) for each of the remaining tendon anchors associated with each of the remaining desired locations for the remaining subsea wells.

15. The method of claim 11, wherein:

the plurality of tendons associated with the first desired subsea location of the first subsea well comprise a first set of tendons; and the plurality of tendons associated with the second desired subsea location of the second subsea well comprise a second set of tendons.

16. The method of claim 11, wherein step (e) further comprises selectively adjusting a length of the each of the mooring lines responsive to sea conditions in order to hold the platform above the first desired subsea location of the first subsea well by selectively tightening and loosening the plurality of the mooring lines.

17. The method of claim 11, wherein step (h) further comprises selectively adjusting a length of the each of the mooring lines responsive to sea conditions in order to hold the platform above the second desired subsea location of the second subsea well by selectively tightening and loosening the plurality of the mooring lines.

* * * * *